United States Patent [19]

Sayers

[11] 4,059,270

[45] Nov. 22, 1977

[54] METHOD FOR CUSTOM FITTING GOLF CLUBS

[76] Inventor: Bernard Sayers, Box 423, Newport, N.J. 08345

[21] Appl. No.: 632,950

[22] Filed: Nov. 18, 1975

[51] Int. Cl.[2] ..... A63B 69/36

[52] U.S. Cl. ..... 273/77 R

[58] Field of Search ..... 273/77 R, 77 A, 79, 273/80 D, 80 A, 80.1, 162 R, 171; 73/379, 488, 493

[56] References Cited

U.S. PATENT DOCUMENTS

| | | | |
|---|---|---|---|
| 1,550,665 | 8/1925 | Barnes | 273/80.1 |
| 1,676,270 | 7/1928 | Mattison | 273/80 A X |
| 2,214,356 | 9/1940 | Wettlaufer | 273/77 R X |
| 3,145,025 | 8/1964 | Morrison et al. | 73/488 X |

OTHER PUBLICATIONS

"The Search for the Perfect Swing" by Cochran and Stobbs; 1968; pp. 4, 204–207; 209–211, 220, 221, 229 and 230; Library of Congress Catalog Card No. 68-9441.

"Golf Digest"; July 1971; pp. 28–33.

*Primary Examiner*—Richard J. Apley

*Attorney, Agent, or Firm*—John J. Byrne; Edward E. Dyson

[57] ABSTRACT

A device utilizing a system of photobeam measurers to detect the speed imparted to a golf ball by a golfer that is utilized with a golf club of adjustable weight and design for determining the optimum club design for a particular individual golfer being tested. The device is used in a method of custom-fitting golf clubs in which the proper swing weight, length, and lie and loft angles of a golf club are determined. The method of fitting consists in a series of steps in which a golfer hits a series of balls through the photobeams with a club which is incrementally lengthened, weighted, and has its lie angle adjusted. The adjustments are made until the point is reached at which the golfer imparts maximum velocity.

5 Claims, 4 Drawing Figures

METHOD FOR CUSTOM FITTING GOLF CLUBS

BACKGROUND OF THE INVENTION

1. Field of the Invention

This invention relates to the game of golf and, specifically, to an apparatus and process for determining the optimum swing weight, length, and lie and loft angles of a golf club for an individual golfer. Heretofore, custom fitting has been primarily achieved by a totally subjective process based on the opinion of a professional in the game and of the "feel " of the golf club to the golfer. This invention relates to an objective approach for determining the optimum swing weight and length of a golf club for an individual golfer.

SUMMARY OF THE INVENTION

With any swing, it is the objective of the golfer to hit a long, well aimed shot with a particular club. While the distance and aim achieved on any particular shot are the subject of many personal factors, such as, timing, coordination, and physical strength, which can only be perfected through practice, there are also many factors affecting a player's game which are related to the equipment he uses. These factors can be optimized by properly fitting the player to his equipment. Two such equipment-related factors capable of optimization through custom fitting are club swing weight and club length. This invention relates to a method for custom fitting equipment with respect to swing weight and club length.

Personal techniques, for example, grip, backswing, hip, arm and wrist movement, are all directed to the ultimate goal of impacting the ball at maximum club head speed. The distance of ball travel is directly related to club length, club mass and club head speed. The process for prescribing a custom golf club, therefore, is mainly one of determining the heaviest and longest club an individual can swing with maximum speed.

The process for that determination is the subject of this invention and comprises two phases. Each phase consists of a series of steps in which the golfer hits a series of shots through a plane of photobeams which are connected to apparatus for measuring and reading the speed of each shot. The photobeams are carried on two pairs of standards located a fixed distance apart. The photobeam system is arranged in an electrical circuit such that, upon interruption of the beams, electrical signals are produced, from which the velocity of the golf club can be determined by methods known to the art.

In the first phase of the process, the optimum golf club swing weight is determined. The golfer hits a series of shots through the photobeam system with a club of relatively low head mass. The average velocity imparted to the golf ball with a club of relatively low mass is then measured by the photobeam system and recorded. An increment of mass is then added to the club head. Mass can be added to the club head in a variety of manners, of which U.S. Pat. Nos. 1,306,029; 1,538,312; 2,163,091; 2,750,194; and 3,692,306 teach a few examples. After recording the velocity of the first series of balls, the golfer hits another series of shots with a more heavily weighted club. The golfer continues adding mass to the club head in increments and measuring the average velocity imparted to the golf ball until a maximum velocity is reached. The club with which the golfer is able to impart the maximum velocity to the ball is best suited for that golfer. The swing weight of that club is then measured by techniques as set forth in my co-pending application entitled "Apparatus for Measuring the Swing Weight of Sporting Implements", filed on even date herewith.

Phase II of the custom fitting process is the determination of optimum club length. The golfer hits another series of shots through the photobeam standards using a relatively short club having the swing weight determined in the first phase of the present process. Again, the average velocity is measured in the manner set forth in Phase I and recorded. A club longer than the first and of the same swing weight is then used to hit another series of shots through the standards and the velocity is again measured. In each step a club longer than the club used in the previous step is used until a maximum velocity is again reached. The club used to obtain the maximum velocity in the final step of the second phase is the club having the optimum length and swing weight for the golfer.

With the foregoing in mind, it is the principal object of this invention to provide an objective approach to fitting golf clubs in which performance is scientifically tied to club length and swing weight.

It is another object of this invention to provide a process for determining optimum club length and swing weight for a particular golfer.

It is still another object of this invention to provide an apparatus utilizing photobeams by which the velocity imparted to a golf ball can be measured.

Another object of this invention is to provide an apparatus which measures the time and angle of flight of a golf ball as it passes between two pairs of standards containing a photobeam system.

Figure 1:
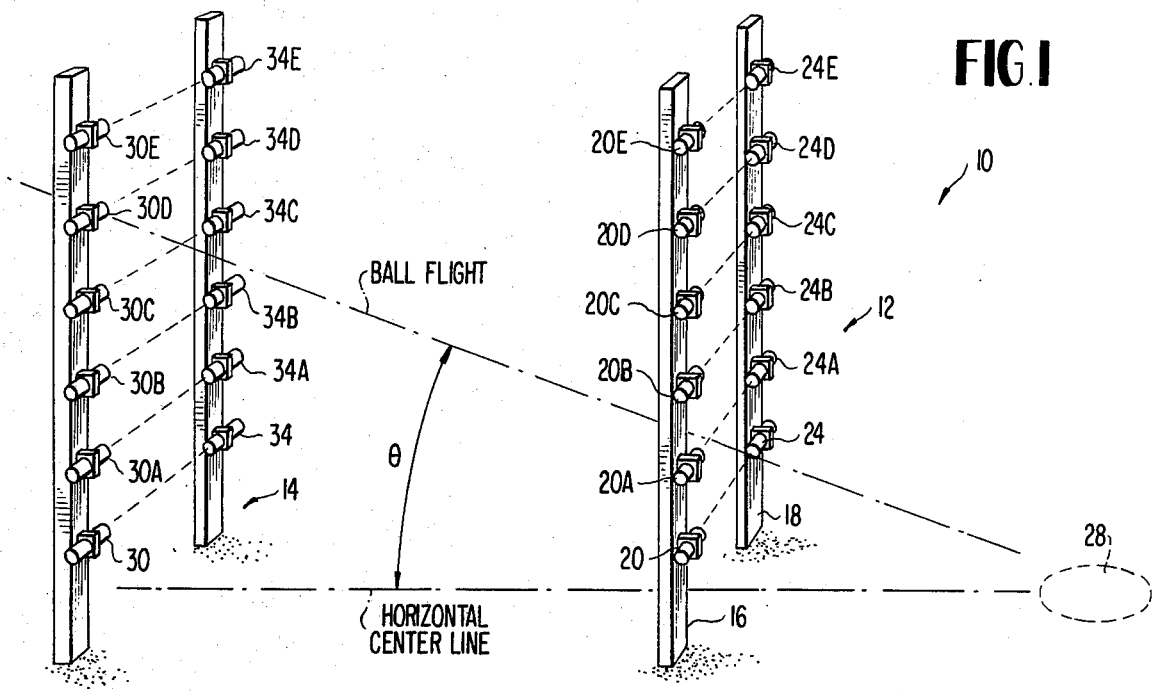
FIG. 1 is a diagrammatic perspective view of the velocity measuring apparatus of this invention.

Referring now to the drawings wherein like numerals indicate like parts, the numeral 10 indicates the velocity measuring apparatus generally. The system includes two banks of sensing devices 12 and 14. The bank 12 includes a pair of standards 16 and 18 spaced from 3 to 4 feet apart. On standard 16 there are a series of light emitters 20 each emitting a light beam to a corresponding light-receptive diode 24 mounted on standard 18 at the same elevation as their corresponding emitter. Bank 14 is constructed in exactly the same manner and is spaced approximately 8 to 10 feet from bank 12 and is located so that the light beams of the respective banks are parallel to one another. The golfer to be fitted will strike the ball from the area indicated by the numeral 28 which is approximately 5 feet from the framework 12.

The emitter 20 will be on the same level as the emitter 30 and the emitter 20A will be on the same level as the emitter 30A, etc. There are many well known devices in the art that can calculate the velocity of an object by calculations performed electronically as a result of interrupting an electron beam or a light beam, or the like. One such system of ball speed measuring devices using light beams is shown in the Morrison U.S. Pat. No. 3,145,025 issued on Aug. 18, 1964. In that patent there is shown a system of measuring the speed of a bowling ball with a corresponding counter readout. The system described by Morrison is exemplary of others in the art. In the instant invention a Morrison-type system is used for each of the systems 20—20, 20A -30A, etc. The systems are arranged in a manner that speed is measured regardless of which light beam was interrupted in bank 12 and which beam was interrupted in bank 14. However, the apparatus is further arranged so that the readout will show which of the beam levels was interrupted at each bank so the angle $\theta$ (called the "lift-off" angle) can also be calculated by reference to a single chart made for that purpose.

Figure 2:
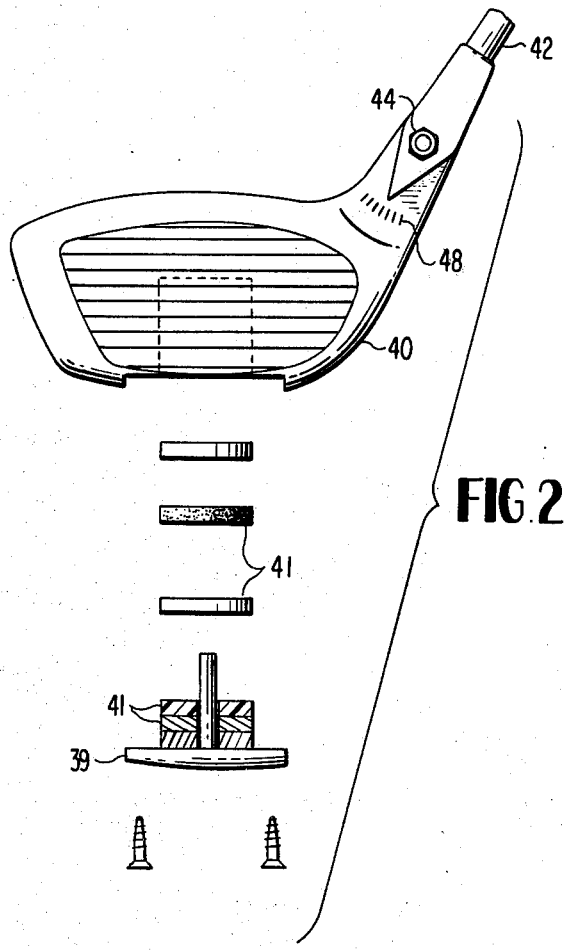
FIG. 2 is a partial side elevation view of a club for use with the apparatus of FIG. 1 showing the adjustable weights.
Figure 3A:
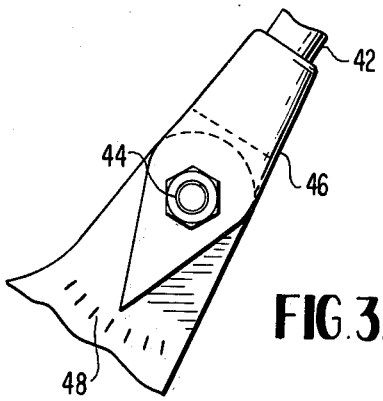
FIG. 3A is an enlarged fragmentary view of FIG. 2
Figure 3B:
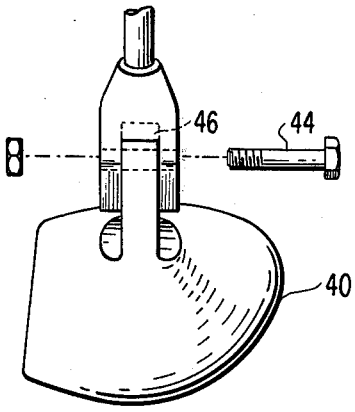
FIG. 3B is an end view of FIG. 2.

As mentioned previously, there are many devices for adding and subtracting weight from a golf club. In FIG. 2, a club 40 is shown that incorporates a series of metal and plastic washers 41 which are used in combination to obtain the desired weight. A removable sole plate 39 is provided. Club 40 also has an adjustable lie device for changing the angle of the club head with its shaft 42. In FIG. 3, there is shown one means of making this adjustment. This means is merely to pivot shaft 42 to an appropriate angle with respect to the club head and tighten same with a screw device 44. As hereinafter described, the instructor or person prescribing the club design will have a number of such clubs with different shaft lengths. The shaft is bifurcated at 46 and is pointed so that it can be aligned with indicia 48.

The first step in determining the optimum club for distance, is to have the golfer hit several balls to warm up and adjust to swinging the club inside a building. The golfer will use his own club if available. He is instructed to swing "normally", as if he were on a golf course.

The instructor will then record the speed of the balls. Hereinafter, a set of three balls is used to determine an average. It, of course, should be understood that more can be included depending on the circumstances. Any reading showing a "mis-hit" or faulty machine performance should be discarded.

The golfer then exchanges his own club for a club 40 which has no weights in it and hits three balls. The speeds are recorded and averaged. The instructor will then add 0.25 ounces of weight; the golfer will hit three additional balls. If the ball speed is increased after a weight addition, it is known that maximum club weight has not been reached. Another 0.25 ounces of weight is added, and three additional balls are hit. This process is continued until the addition of weight reduces speed. When the speed reduction point is reached, half the amount of a weight is removed and three more balls are hit. The speed is again recorded. If the speed has increased from the lower speed but is still less than the previous, more weight is subtracted until a point of maximum speed is reached.

When the point of maximum speed is reached the club is weighed on the Sayerscale (the instrument described in my co-pending application) to determine the swing weight. The swinging weight at this point is recorded.

At this point, the swing weight best suited for the golfer is known. A club 40 is now chosen ½ inch longer than the one first used. Weight is added to the club to bring its swing weight to that of the previously used club. The second club is put on the scale and confirmed to be the correct within ± 0.0625 inch-ounces.

Three more balls are hit using the longer club corrected to optimum swinging weight and the speeds are recorded. If the speed is greater than that attained with the shorter club, another club ½ inch longer is weighted to the optimum weight and three more balls are hit and recorded. If the speed continues to increase, another club is chosen and the process is continued until the speed reaches a drop-off point. At that point the next shortest increment club is used to hit three additional balls. That club will normally produce a faster speed; if not, dropping back to the previous club length will produce the optimum length.

At this point in the process both swing-weight in inch-ounces and the length in inches is known. These figures become the figures that the manufactured club will have for the golfer.

To adjust for optimum lie; i.e., the angle between the head and the shaft, further series of balls are hit with golf clubs having the swing weight and shaft length previously determined, and the angle between the club head and the shaft is adjusted until a further maximum velocity is obtained. The optimum swinging weight, optimum length, and optimum lie angle are now known and available for use in making the new club.

Although not part of this invention, other features are incorporated into the final design of the club. For instance, a personal history of past golf performance might indicate any design correction which should be made to correct for hook or slice. The outline of the golfer's upper hand is used as an indication of the size of grip on the new club.

Finally, the loft of the club is determined. Most golfers need a face with a few degrees more loft than the "standard". A non-professional will usually need a few degrees more to permit him to get the ball high enough for maximum travel. An inspection of the golfer's own driver to determine its loft and a discussion with him concerning how he hits the ball high, low, medium, will give the instructor an idea of optimum loft. These observations can be checked by observing the angle $\theta$ during the testing hits.

In a general manner, while there has been disclosed an effective and efficient embodiment of the invention, it should be well understood that the invention is not limited to such an embodiment, as there might be changes made in the arrangement, disposition, and form of the parts without departing from the principle of the present invention as comprehended within the scope of the accompanying claims.

I claim:

1. A method of custom designing a golf club for a particular individual golfer which will give the maximum distance of ball travel, said method comprising the steps of:

a. providing means for adjusting the club head weight, lie angle, and golf club shaft length used by the particular individual golfer during the practicing of this method;

b. providing means for measuring the velocity and loft angle of golf balls hit by the particular individual golfer during the practicing of this method;

c. hitting a series of golf balls with a golf club the club head weight of which is a predetermined minimum and calculating the average velocity of said golf balls;

d. hitting another series of golf balls with a golf club the club head weight of which is incrementally greater than in the previous step and calculating the average velocity of said golf balls;

e. continuing to hit further series of golf balls with golf clubs having club head weights which are incrementally greater than in the previous step and calculating the average velocity of each series until a first maximum velocity is established;

f. calculating the swing weight of the golf club which produced said first maximum velocity;

g. hitting a series of golf balls with a golf club having a swing weight producing said first maximum velocity and a shaft the length of which is a predetermined minimum and calculating the average velocity of said golf balls;

h. hitting another series of golf balls with a golf club having a swing weight producing said first maximum velocity and a shaft length of which is incrementally longer than in the previous step and calculating the average velocity of said golf balls;

i. continuing to hit further series of golf balls using golf clubs having a swing weight producing said first maximum velocity and shafts the lengths of which are incrementally larger than in the previous step and calculating the average velocity of each series until a second maximum velocity is established;

j. hitting a series of golf balls with a golf club having a swing weight producing said first maximum velocity and a shaft length producing said second maximum velocity and a predetermined lie angle and calculating the average velocity of said golf balls;

k. continuing to hit further series of golf balls using golf clubs having a swing weight producing said first maximum velocity and a shaft length producing said second maximum velocity and a lie angle which is incrementally different than in the previous step and calculating the average velocity of each series until a third maximum velocity is established; and l. calculating the average lift-off angle of a series of balls hit with a golf club having a swing weight producing said first maximum velocity, a shaft length producing said second maximum velocity, and a lie angle producing said third maximum velocity and determining from said average lift-off angle the optimum loft angle for the particular individual golfer.

2. A method as recited in claim 1 employing golf clubs having adjustable club head weights wherein incremental weights are added to the club head of a single golf club in steps (d) and (e) of claim 1.

3. A method as recited in claim 2 employing golf clubs having adjustable lie angles wherein the lie angles of a single golf club is varied in steps (j) and (k) of claim 1.

4. A method as recited in claim 1 employing golf clubs having adjustable lie angles wherein the lie angle of a single golf club is varied in steps (j) and (k) of claim 1.

5. A method as recited in claim 1 and including the further steps of reducing the club head weight by half the increment added in the previous step and hitting a further series of balls when the most recent addition of an incremental weight has decreased the average velocity of said golf balls.

* * * * *